US006847157B2

(12) United States Patent
Kling et al.

(10) Patent No.: US 6,847,157 B2
(45) Date of Patent: Jan. 25, 2005

(54) DIELECTRIC BARRIER DISCHARGE LAMP HAVING CONTACT SPRINGS

(75) Inventors: Rainer Kling, Dossenheim (DE); Reinhold Wittkoetter, Wermelskirchen (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 211 days.

(21) Appl. No.: 10/130,604

(22) PCT Filed: Sep. 24, 2001

(86) PCT No.: PCT/DE01/03679

§ 371 (c)(1),
(2), (4) Date: May 21, 2002

(87) PCT Pub. No.: WO02/27762

PCT Pub. Date: Apr. 4, 2002

(65) Prior Publication Data

US 2002/0163312 A1 Nov. 7, 2002

(30) Foreign Application Priority Data

Sep. 27, 2000 (DE) ..... 100 48 986

(51) Int. Cl.[7] ..... H01J 65/00
(52) U.S. Cl. ..... 313/234; 313/607
(58) Field of Search ..... 313/607, 35, 46, 313/234, 238

(56) References Cited

U.S. PATENT DOCUMENTS

| | | | | |
|---|---|---|---|---|
| 4,342,940 | A | 8/1982 | Mrusko et al. | |
| 5,008,588 | A | 4/1991 | Nakahara | |
| 5,272,414 | A | 12/1993 | Iwanaga | |
| 6,294,869 | B1 * | 9/2001 | Adachi et al. | 313/607 |

FOREIGN PATENT DOCUMENTS

| | | | |
|---|---|---|---|
| DE | 0433916 A1 * | 6/1991 | H01J/61/44 |
| EP | 0 433 916 | 6/1991 | |
| EP | 0 703 603 | 3/1996 | |
| WO | WO 98/11596 | 3/1998 | |
| WO | WO 98/49712 | 11/1998 | |

* cited by examiner

*Primary Examiner*—Vip Patel
*Assistant Examiner*—Joseph Williams
(74) *Attorney, Agent, or Firm*—Robert F. Clark

(57) ABSTRACT

A dielectric barrier discharge lamp having a cap (2), an elongate discharge vessel (1) and strip-like outer electrodes (5*a*–5*f*) has a corresponding contact spring (7*a*–7*f*) for each outer electrode. These contact springs are arranged in the interior of the cap. The cap also includes a cap sleeve (6), which surrounds one end of the discharge vessel (1) in such a manner that the or each strip-like outer electrode (5*a*–5*f*) is in electrically conductive contact with the or a corresponding contact spring (7*a*–7*f*). Preferably, the transverse extent of the individual contact springs, at least in the region of the contact, is less than or equal to the width of the corresponding strip-like outer electrode. This design combines ease of installation of the cap with a reliable contact and a high lamp efficiency.

8 Claims, 1 Drawing Sheet

FIG. 1a
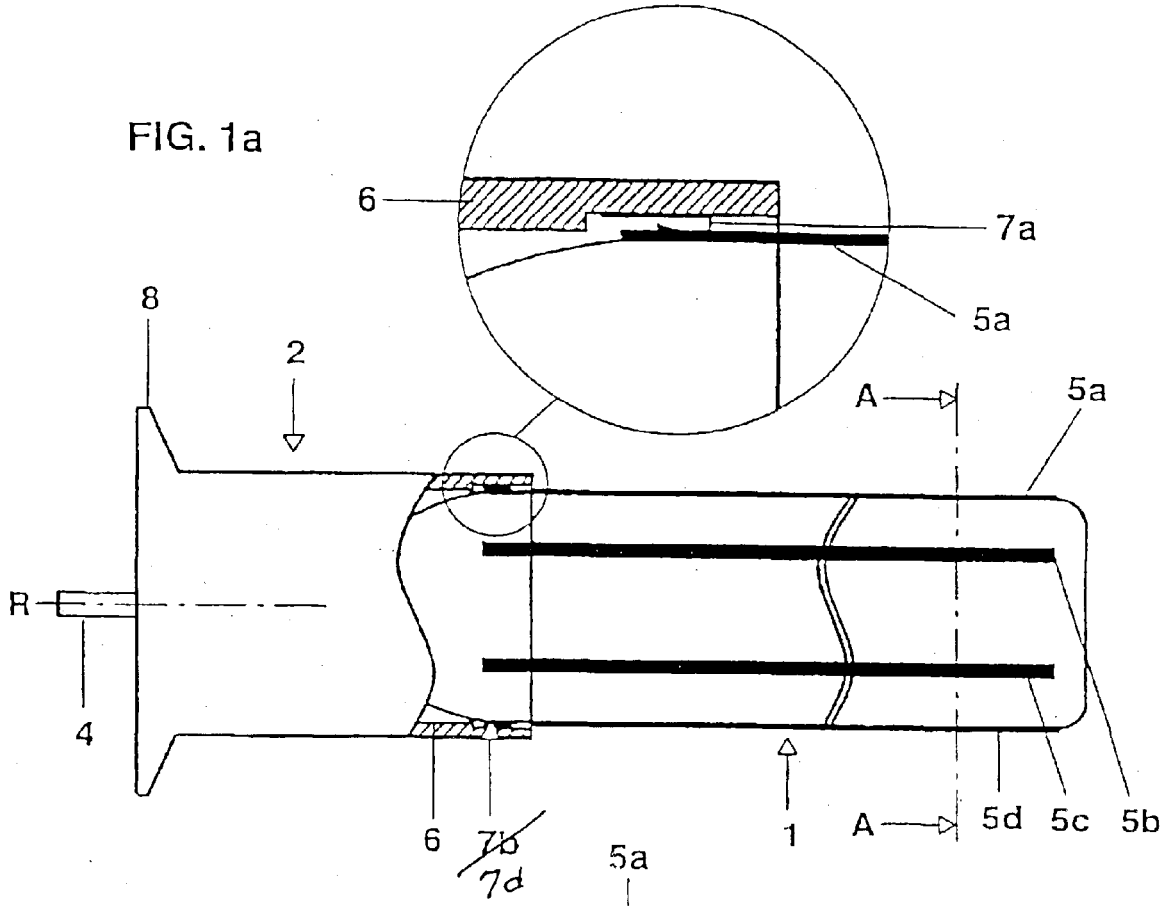
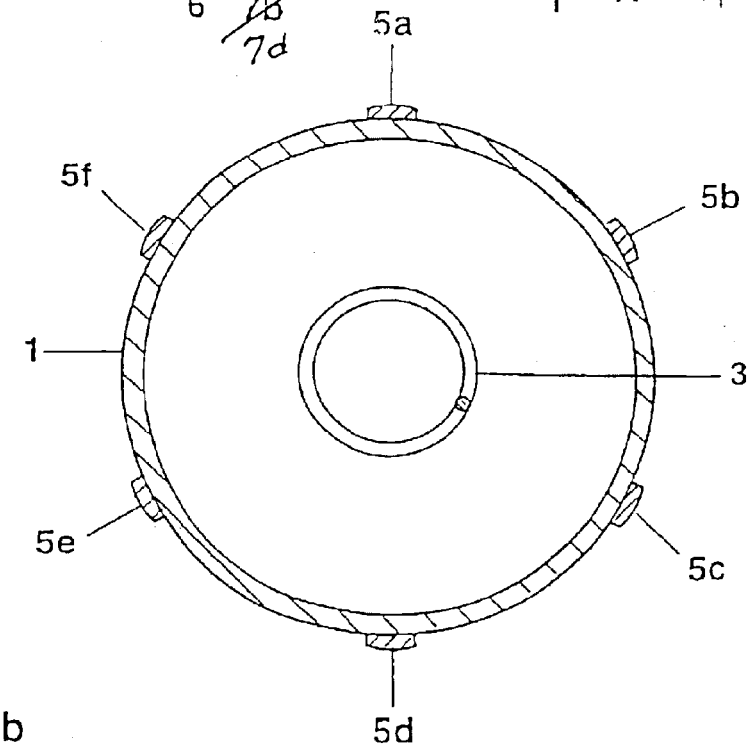
FIG. 1b
A–A

DIELECTRIC BARRIER DISCHARGE LAMP HAVING CONTACT SPRINGS

TECHNICAL FIELD

The invention is based on a dielectric barrier discharge lamp.

The term "dielectric barrier discharge lamp" in this case encompasses sources of electromagnetic radiation based on dielectrically impeded gas discharges. The spectrum of the radiation may encompass both the visible region and the UV (ultraviolet)/VUV (vacuum ultraviolet) region, as well as the IR (infrared) region. Furthermore, it is also possible to provide a phosphor layer in order to convert invisible radiation into visible radiation (light).

A dielectric barrier discharge lamp necessarily requires at least one dielectrically impeded electrode. A dielectrically impeded electrode is separated from the interior of the discharge vessel by means of a dielectric. By way of example, this dielectric may be designed as a dielectric layer which covers the electrode, or may be formed by the discharge vessel of the lamp itself, specifically if the electrode is arranged on the outer wall of the discharge vessel. In the text which follows, the latter arrangement is known as an "outer electrode" for short.

The present invention relates to a dielectric barrier discharge lamp having an elongate or tubular discharge vessel which is closed off on both sides and surrounds an ionizable fill.

The ionizable fill usually comprises a noble gas, for example xenon, or a gas mixture. During the gas discharge, which is preferably operated by means of a pulsed operating method described in U.S. Pat. No. 5,604,410, what are known as excimers are formed. Excimers are excited molecules, e.g. $Xe_2^*$, which on returning into the basic, generally unbonded state, emit electromagnetic radiation. In the case of $Xe_2^*$, the maximum of the molecular band radiation is at approximately 172 nm.

Moreover, the lamp has at least one outer electrode of the abovementioned type, the or each outer electrode being substantially in the form of a strip.

BACKGROUND ART

The document U.S. Pat. No. 6,060,828, in particular FIGS. 5a to 5c, has already disclosed a lamp of this type with an Edison screw base, for general illumination. This lamp has a helical electrode inside the discharge vessel. Moreover, four strip-like electrodes are arranged on the outer wall of the discharge vessel. However, there are no details as to how the strip-like outer electrodes are connected to one of the two base contacts.

DISCLOSURE OF THE INVENTION

It is an object of the present invention to provide a dielectric barrier discharge lamp having at least one strip-like outer electrode and a cap, in such a manner that simple and reliable contact between the or each outer electrode and a base contact is ensured.

This object is achieved by a discharge lamp, having an elongate discharge vessel which is closed on both sides and surrounds an ionizable fill, one or more strip-like outer electrodes which is or are arranged on the outer wall of the discharge vessel, a cap having a cap sleeve, one or more contact springs which is or are arranged in the interior of the cap, the number of contact springs being equal to the number of the strip-like outer electrodes, and the cap sleeve surrounding one end of the discharge vessel, in such a manner that the or each strip-like outer electrode is in electrically conductive contact with the or a corresponding contact spring.

Particularly advantageous configurations are given in the dependent claims.

According to the invention, a corresponding contact spring is provided for each strip-like outer electrode of the dielectric barrier discharge lamp. These contact springs are arranged in the interior of the cap. The cap also comprises a cap sleeve, which surrounds one end of the discharge vessel in such a manner that the or each strip-like outer electrode is in electrically conductive contact with the or a corresponding contact spring.

The advantage of this design consists, inter alia, in the ease of production of the lamp, since the cap sleeve is simply fitted onto the discharge vessel end, each contact spring being brought into electrically conductive contact with a corresponding outer electrode. Moreover, the contact positions are protected from mechanical effects by the cap sleeve.

In this context, the term "strip-like outer electrode" is to be understood in a general sense, to the extent that a strip-like outer electrode does not necessarily have to be straight, but rather, by way of example, may also be curved or have a substructure. Moreover, the strip-like outer electrode may also be reduced to a "linear electrode", in the sense that the width of the electrode may be very low compared to its length. All that is important in the context of the contact-making according to the invention is that at least those areas of the outer electrodes which are in contact with the contact springs are in each case designed as contact surfaces which are at least similar to strips.

If necessary, the discharge vessel end may additionally be joined to the cap sleeve by means of an additional attachment means, for example cement or adhesive, in order to increase the mechanical stability.

At first glance, it appears eminently expedient—as disclosed in FIG. 5a of U.S. Pat. No. 6,060,828, which was cited in the introduction—for the ends of all the outer electrodes of one polarity initially to be connected to one another in an electrically conductive manner, for example by means of a ring or strip-like band (denoted by reference 52e in that document), which surrounds the entire circumference of the discharge vessel at one end of the strip-like outer electrodes. In the prior art, this common conductor is connected to the associated cap contact. However, it has been found that in this solution the dielectrically impeded discharge inside the discharge vessel is impaired, and consequently the efficiency of the lamp is reduced.

This negative effect is substantially avoided by the abovementioned measure according to the invention. In this context, it is particularly advantageous if the transverse extent of the individual contact springs, at least in the region of the contact, is less than or equal to the width of the corresponding strip-like outer electrode.

In a preferred embodiment, the contact springs are designed as narrow leaf springs. The abovementioned transverse extent in this case corresponds to the respective width of the leaf springs. To make it easier to fit on the cap and to ensure a reliable contact, it is advantageous for the or each leaf spring to be bent into a type of resilient loop.

The contact springs usually consist of $CuBe_2$. When using the discharge lamp as a UV radiator, on account of its resistance to UV radiation, it is preferable to use contact springs made from stainless steel. Platinum is also particularly suitable, but is relatively expensive.

In a preferred embodiment, the cap sleeve consists of an electrically conductive material, for example metal. In this case, the contact springs are connected to the cap sleeve in an electrically conductive manner. In this way, the cap sleeve, as well as having an installation function, also acts as a cap contact of a first polarity. In other words, all the outer electrodes of a first polarity can be connected, by means of the contact springs, via the electrically conductive cap sleeve, to a first pole of an electrical supply unit.

The electrodes of the second polarity may in principle also be designed as outer electrodes, or alternatively may be designed as an inner electrode, i.e. may be arranged inside the discharge vessel.

By way of example, a preferred embodiment has a helical inner electrode which is arranged axially oriented inside the discharge vessel, as disclosed in U.S. Pat. No. 6,060,828, which has already been cited. The inner electrode is connected to a cap contact of a second polarity via a current leadthrough which is rendered gastight in a known way. In the most simple case, this cap contact may be designed as a pin. To achieve an electrically and mechanically reliable connection to the mating piece of an electrical power supply unit, the cap sleeve may be suitably extended, for example as a flanged, threaded or bayonet cap. In the specific individual case shown here, the features of the device or mount into which the discharge lamp is to be fitted are of decisive importance.

Finally, the discharge lamp may also be capped on both sides, i.e. the discharge vessel may be provided with a cap at each of its two opposite ends. In this case, both caps may be provided for electrical contact, i.e. may be equipped to provide an electrical connection function. In this case, the contact with the outer electrodes may also be divided between the two caps, for example by forming electrical contact with a first half of the outer electrodes by means of one cap and with the second half by means of the other cap. Moreover, particularly in the case of very long lamps it may be advantageous for the electrodes to be halved and for each electrode half to be supplied with power by the corresponding cap, in order to improve the uniformity along the discharge lamp. On the other hand, it may also be advantageous to use only one cap to be used as a connection interface for an electrical supply unit and for the other cap merely to have a securing function for an installation component.

BRIEF DESCRIPTION OF THE DRAWINGS

In the text which follows, the invention is to be explained in more detail with reference to an exemplary embodiment, in which:

FIG. 1*a* shows a dielectric barrier discharge lamp according to the invention with cap, partially in section, FIG. 1*b* shows a sectional illustration on line AA through the lamp shown in FIG. 1.

BEST MODE FOR CARRYING OUT THE INVENTION

FIGS. 1*a* and 1*b* provide diagrammatic illustrations of a dielectric barrier discharge lamp according to the invention, with a cap which is shown partially in section, and a sectional illustration on line AA, respectively. Identical features are provided with identical reference numerals. This lamp serves as a UV (ultraviolet)/VUV (vacuum ultraviolet) radiator for ozone generation and radiation, for example in photolithography, UV curing of wafers, photolysis and the like.

The lamp comprises a tubular discharge vessel 1 with electrodes and a cap 2 with cap contacts.

Xenon is situated inside the discharge vessel 1, which is made from quartz glass, as the fill gas with a fill pressure of 15 kPa. Moreover, a helical electrode 3 (which can only be seen in FIG. 1*b*) made from metal wire is arranged axially inside the discharge vessel 1. The inner electrode 3 is connected in an electrically conductive manner to a contact pin 4 which is integrated in the cap 2, by means of a gastight current leadthrough (not shown) which is known per se. The contact pin acts in this way as a cap contact for the inner electrode 3.

Six strip-like outer electrodes 5*a* to 5*f* made from platinum are arranged on the outer wall of the tubular discharge vessel 1, which is circular in cross section, distributed uniformly over the circumference of the discharge vessel 1 and parallel to its longitudinal axis R.

During pulsed operation, numerous partial discharges are generated inside the discharge vessel 1. For further details in this respect and for design details relating to the electrode configuration, reference is made to FIGS. 5a to 5c, as well as the associated description of the figures, of U.S. Pat. No. 6,060,828, which has already been cited.

The cap 2 has a cap sleeve 6 made from aluminum, which is pushed over the first end of the discharge vessel 1, which has the current leadthrough of the inner electrode 3, sufficiently far for approx. 5 mm of the associated end of the outer electrodes 5*a*–5*f* to be covered. The magnified illustration shows that six contact springs 7*a*, 7*d* (the contact springs 7*b*, 7*c*, 7*e* and 7*f* are not visible) are attached to the inner wall of the cap sleeve 6. The connection between the contact springs 7*a*, 7*d* and the cap sleeve 6 is electrically conductive. Moreover, the contact springs 7*a*, 7*d* are arranged in such a way that they are in resilient contact with the corresponding outer electrodes 5*a* to 5*f*. In order on the one hand to make it easier to fit the cap 2 or the cap sleeve 6 onto the end of the discharge vessel and, on the other hand, to ensure a reliable contact, all the contact springs 7*a* (the contact springs 7*b* to 7*f* not being visible in FIG. 1*a*) are designed as leaf springs which are bent in the opposite direction to the direction in which the cap is fitted on, to form a type of resilient loop. In this way, the cap sleeve 6 functions as a cap contact for the outer electrode 5. To protect against electric shock, the cap sleeve 6 for the electric connection is provided with ground potential. By contrast, the cap pin 4, which is not accessible in the installed state, is provided for connection to high-voltage potential. On account of the different electrical potentials, the cap pin 4 is, of course, sufficiently electrically insulated with respect to the cap sleeve 6 in a manner which is known per se, for example by the cap pin 4 being embedded in a cap insulator made from insulating material (not shown).

The width of the strip-like outer electrodes 5*a* to 5*f* is in each case approx. 1 mm, and that of the contact springs 7*a* is in each case 1 mm. This ensures that the discharge lamp operates efficiently.

At its end which is remote from the discharge vessel 1, the cap sleeve 6 is continued in the form of a flange 8. The flange 8 allows secure installation on a support (not shown), which is responsible both for the electrical connection between cap 8 and the supply conductors from an electrical power supply source and for mechanical holding of the lamp. Flange connections are standard in many areas of vacuum technology. Therefore, this exemplary embodiment is particularly suitable for installation in UV radiation reactors which can be evacuated.

What is claimed is:

1. A dielectric barrier discharge lamp, comprising:

an elongate discharge vessel enclosing an ionizable fill, at least one inner electrode arranged inside the discharge vessel, one or more strip-like outer electrodes arranged on the outer wall of the discharge vessel, a cap having a cap sleeve surrounding one end of the discharge vessel; and one or more contact springs arranged in the interior of the cap, the number of contact springs being equal to the number of the strip-like outer electrodes wherein each contact is in electrical contact with a corresponding outer electrode, the transverse extent of each contact spring being less than or equal to the width of the corresponding strip-like outer electrode.

2. The discharge lamp as claimed in claim 1, in which each contact spring is designed as a leaf spring.

3. The discharge lamp as claimed in claim 2, in which each leaf spring is bent into a resilient loop.

4. The discharge lamp as claimed claim 1, in which the cap sleeve consists of an electrically conductive material, and each contact spring is connected in an electrically conductive manner to the cap sleeve whereby the cap sleeve acts as a cap contact of a first polarity.

5. The discharge lamp as claimed in claim 4, in which the cap sleeve is continued as a flange.

6. The discharge lamp as claimed in claim 1, in which the inner electrode is helical and is axially oriented.

7. The discharge lamp as claimed in claim 4, in which the inner electrode is connected to a cap contact of a second polarity.

8. The discharge lamp as claimed in claim 1, in which the discharge vessel has caps on both ends and has two groups of outer electrodes arranged on the outer wall wherein one cap is in electrical contact with one group of outer electrodes and the other cap is in electrical contact with the other group of outer electrodes.

* * * * *